US008555485B2

(12) United States Patent
Carrasco Aguirre et al.

(10) Patent No.: US 8,555,485 B2
(45) Date of Patent: Oct. 15, 2013

(54) METHOD FOR NOISE REDUCTION IN TRANSFORMERS

(75) Inventors: Raymundo Carrasco Aguirre, Nuevo León (MX); Eduardo Herrera Saucedo, Nuevo León (MX); Luis Ernesto Mora Forsbach, Nuevo Leon (MX); Eduardo Martínez Escobedo, Nuevo Leon (MX); Sergio Camilo Ruiz Escobedo, Nuevo León (MX); Humberto Gerardo Mota Mireles, Nuevo León (MX)

(73) Assignee: Prolec GE Internacional, S. de R.L. de C.V., Apodaca, Nuevo Leon ( * ) Notice: Subject to any disclaimer, the term of this patent is extended or adjusted under 35 U.S.C. 154(b) by 281 days.

(21) Appl. No.: 13/190,044

(22) Filed: Jul. 25, 2011

(65) Prior Publication Data

US 2012/0260495 A1 Oct. 18, 2012

(51) Int. Cl.
*H01F 7/06* (2006.01)

(52) U.S. Cl.
USPC ..... 29/602.1; 29/603.02

(58) Field of Classification Search
USPC ..... 29/602.1, 603.02, 592.1, 854; 336/60, 336/92, 100, 229; 428/304.4, 308.4, 317.9
See application file for complete search history.

(56) References Cited

U.S. PATENT DOCUMENTS 2,942,216 A * 6/1960 Camilli et al. ..... 336/92
5,965,249 A * 10/1999 Sutton et al. ..... 428/304.4
7,271,696 B2 * 9/2007 Piaskowski ..... 336/229

* cited by examiner

*Primary Examiner* — Thiem Phan
(74) *Attorney, Agent, or Firm* — Miller, Matthias & Hull LLP

(57) ABSTRACT

A method for reducing noise in an electric transformer uses a rigid fastening member during transportation which is uncoupled during its operation, leaving the live part of the transformer coupled to a tank through damper elements reducing vibration transmission from the live part to the tank, reducing the noise emitted by the transformer.

5 Claims, 4 Drawing Sheets

METHOD FOR NOISE REDUCTION IN TRANSFORMERS

FIELD OF THE DISCLOSURE

This disclosure generally relates to electric transformers, and more particularly to a method for fastening internal pieces of a transformer during transportation and decreasing noise generated during operation.

BACKGROUND OF THE DISCLOSURE

Main noise sources in electric transformers are: the transformer core, its coils, and the cooling system, whether fans or pumping systems (oil-cooled transformers).

Due to the growth in urban areas it is frequent to find power transmission substations in densely populated areas. Therefore transformer noise in these substations becomes a nuisance for neighbor establishments and houses. Several cities in North America have very stringent regulations as to the maximum noise level which may be produced by a transformer. In order to meet environmental regulations, solutions for ameliorating transformer noise have been developed. These solutions include the use of a low permeability core material, decreasing magnetic flow density thereof, building concrete casings around the transformer, and others. By applying current solutions (reduced flow density and higher permeability material) a remarkable reduction in transformer noise is achieved, however they are not sufficient for reaching extra-low noise levels demanded by environmental regulations.

There is a disadvantage of considerably increasing the land required for transformer installation in the case of a concrete casing making it less attractive. A proposed solution disclosed herein increases transformer noise reduction by allowing reaching an extra-low noise level and not requiring an increase of the required area for transformer installation.

In order to suppress these and other drawbacks, an alternative method to those known was decided to develop for decreasing transformer noise. Noise is produced by internal component vibration transmission outside of the transformer. The subject matter disclosed herein limits this vibration transmission.

BRIEF DESCRIPTION OF THE DRAWINGS

Other objects and features of present disclosure shall be apparent from the following detailed description when taken in connection with attached drawings. However, it shall be understood that drawings are designed only as an illustration and not as a limitative definition of the claims. In the drawings, reference numbers designate similar elements along different views:

DETAILED DESCRIPTION

Transformers experience large accelerations during transportation to final destination; thus in order to prevent any damage, the live part 1 being the transformer section performing electric functions, in this case the set of core, coils and fittings, is anchored to the tank in a number of ways. One of these methods is permanently fastening the fitting ends 5 to the short tank walls of the transformer.

Figure 1:
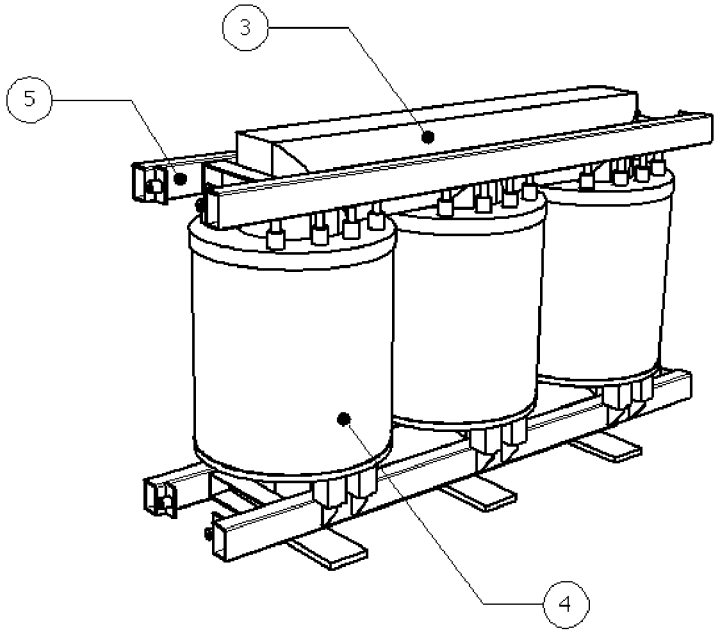
FIG. 1 shows a live part assembly, comprising the three-phase core, three coils and fittings keeping coupled all the components.

FIG. 1 shows a live part of a three-phase transformer and is formed by a core 3 being the central section, three copper coils 4, and fittings 5 serving for mechanical fastening of live part 1.

Figure 2:
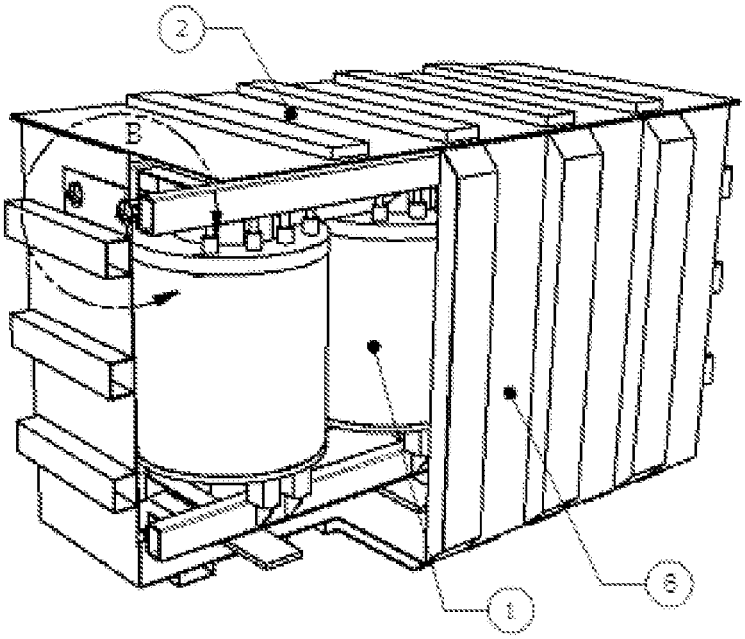
FIG. 2 shows a perspective of the transformer with a cross-section in tank wall.

FIG. 2 shows the transformer 2, being the electromagnetic device allowing an increase or decrease in voltage and current intensity, housed in a tank 6 which is an oil and live part 1 container.

Figure 3:
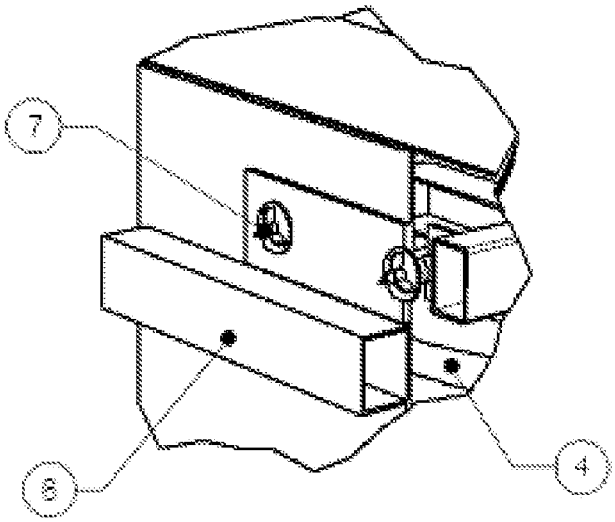
FIG. 3 shows the detail "B" of the transformer short wall depicted in FIG. 2, wherein two rigid fastening members of the live part are shown.

FIG. 3 shows a close-up for detail "B" shown in FIG. 2, which shows two conventional rigid fastening members 7 from live part 1 to tank 6, which are non-removable mechanical connections.

In order to decrease vibration transmission from live part 1 towards tank 6 and then the outer noise, a fastening member is proposed for disconnecting the mechanical interaction between the live part 1 and the tank 6. This uncoupling shall be performed only during transformer operation, since a mechanical rigid connection is only beneficial and necessary during transformer transportation.

Proposed method includes only a single attachment to work in two situations:

1) Transportation (rigid fastening member),

2) Operation (damped fastening member).

Figure 4:
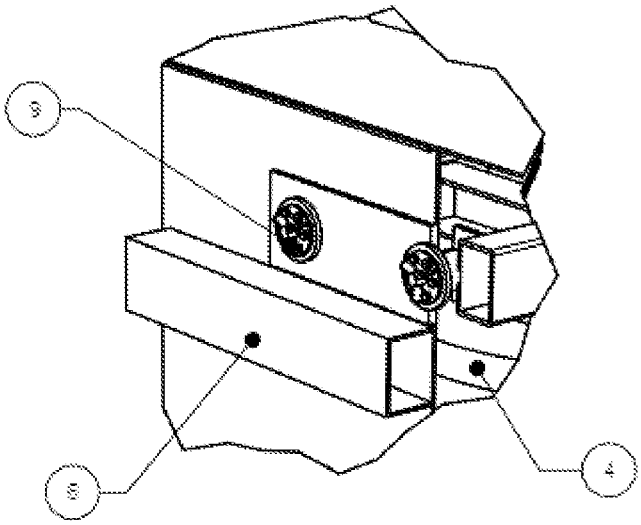
FIG. 4 shows the proposed solution in a transformer with rigid fastening member during transportation.

FIG. 4 shows the transformer with its rigid fastening member connected to the live part during transportation. Fittings 5 are immobilized through an outer connector 8, which is a mechanical metallic element for fixing the live part to the tank, having sufficient rigidity for withstanding transportation accelerations over the live part 1 of the transformer. The outer connector 8 has the purpose of fastening a removable connector 9 during transportation and the removable element 10 during transformer operation 2, said outer connector 8 is fixed to the tank 6 and to the removable connector 9 which works during transformer transportation resisting acceleration forces undergone by equipment, this being a removable screw for temporary attachment of the live part 1, wherein removable connectors 9 fixedly attach the live part 1 of the transformer 2 with the tank 6 thereof.

Figure 5:
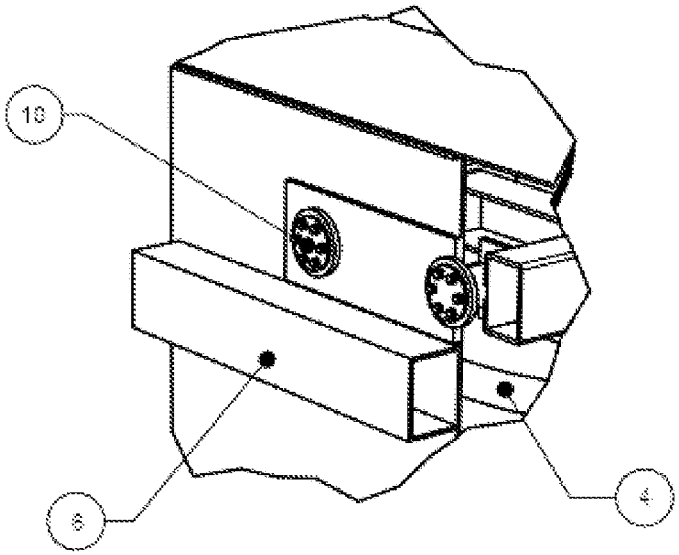
FIG. 5 shows the proposed solution in a transformer with a damped fastening member during operation.

FIG. 5 shows the transformer 2 in operation. Once at the definitive operation site the removable connector is withdrawn and inner part of transformer 2 is sealed with a removable element in every connection point to the tank 6, the removable element 10 being a removable closure for damped fastening member, this closure tightly seals transformer 2 inner parts during operation thereof.

The live part 1 is connected with the tank 6 through damper elements 11 comprised in the outer connector 8 substantially reducing vibration transmission to the tank 6 of the transformer 2 having the function of absorbing vibrations at specific frequency as produced by coils and transformer core 2. It is worth to mention that damper elements are assembled from transformer manufacturing and not at installation site, since they work only during transformer operation 2.

Figure 6:
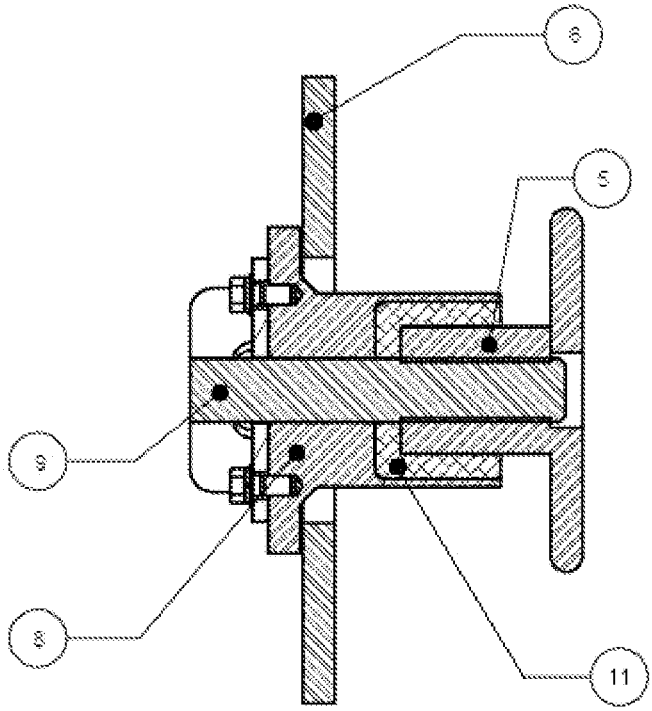
FIG. 6 is a cross-section view of a fastening member during transportation, with a removable connector rigidly coupled to a fitting.

FIG. 6 shows a cross-section of the transformer rigid fastening member 2 during transportation thereof. Tank wall 6 in the transformer 2 is shown being permanently attached to the outer connector 8. The removable connector 9 is screwed at fitting end 5 and outside the tank 6 to the outer connector 8. Rigid coupling between fittings 5 and tank 6 withstands accelerations imposed by road conditions during transformer transportation. Another feature of this coupling is tightly sealing tank 6 interior of the transformer. This is indispensable as pollutant and moisture entry into equipment should be prevented.

Figure 7:
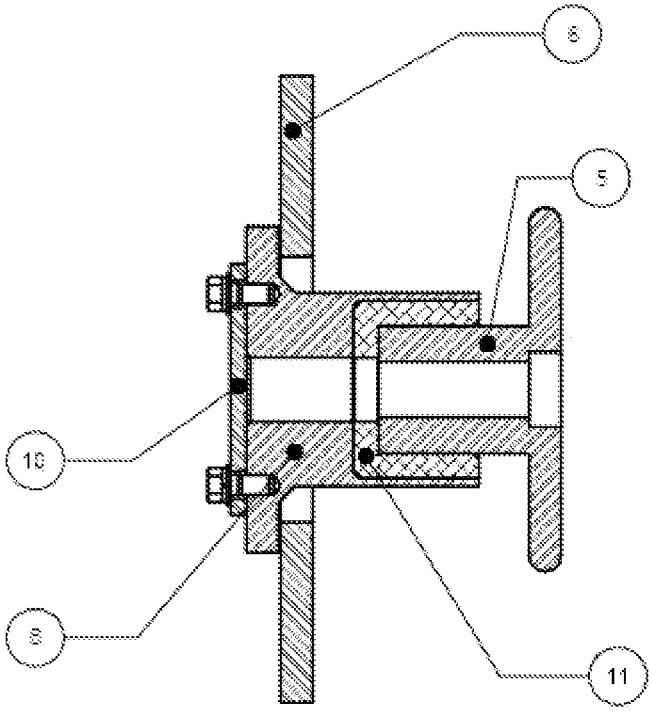
FIG. 7 is a cross-section view of a fastening member during transformer operation.

FIG. 7 shows a cross-section of a damped fastening member of the transformer during operation thereof. Tank wall 6 of the transformer 2 is shown to be permanently attached to outer connector 8. The removable connector 9 is replaced once that the transformer is in field, by the removable element 10. Function of said element is tightly seal tank interior 6 of the transformer. Upon withdrawing the removable connector, the fittings are released and the only mechanical connection between them and the tank are the damper elements 11. Said elements 11 are designed to absorb the vibrations produced at certain frequencies by the coil(s) 4 and core 3 of the transformer.

Another design requirement of these damper elements 11 is to withdraw stresses produced during a seismic event. Other conditions where damper elements 11 are subject to are a high temperature and a pressure up to 15 pounds per square inch during transformer operation 2, thus producing an accelerated aging in conventional materials therefore they would be unsuitable for this application as transformer life should be at least 30 years.

Once the transformer is in operation, the core laminations 3 will cyclically deform due to a magnetostriction phenomenon. This deformation creates a vibration transmitted from the live part 1 to the tank 6 through its couplings. In addition to the vibration produced by the core 3, vibration produced by electromagnetic forces present in the coils 4 is also added. These vibrations have high amplitude peaks or values at certain frequencies, damper element 11 function is to limit vibration amplitude in the coupling between fittings 5 and outer connector 8.

Upon limiting amplitude of this vibration in tank walls 6 of the transformer 2, the result of wall tank 6 reduction is a lower noise level produced outside the transformer 2.

In order to prove noise reduction outside the transformer, equipment which measures air sound pressure (sound meter) in transformer periphery may be used.

This noise reduction is also reflected into a benefit for those persons living around the zone where a transformer is located, upon decreasing auditive pollution.

During transformer 2 operation, voltage transformation between input and output terminals is achieved passing an electric current through a coil called primary (not shown), which induces a magnetic flow transmitted from the core formed by silicon steel laminations, which when passing through a secondary coil (not shown) having a different number of turns in conductor compared to primary induces current, thus achieving a voltage change in apparatus output terminals, said primary and secondary coils form the inner part of the coils 4. In this process, core laminations 3 undergo mechanical deformations translated into vibration upon conducting a variable magnetic flow. These vibrations are mainly generated in the coils 4 and the core 3, which when transmitted outside become into audible noise. Upon commissioning the transformer 2, vibrations generated in live part 1 are damped by damped fastening member and thus transformer 2 noise level remarkably decreases.

In the light of above description, the method for noise reduction may be stated as effective and having a lower cost than currently described solutions.

Having described in detail embodiments intended to be illustrative but not limitative whereby noise reduction in transformers is carried out, it will be apparent for those skilled in the art that modifications and variations may be performed in the light of above teachings. Therefore it is understood that changes may be effected in the specific embodiments of the present disclosure which are within the scope and spirit of the attached claims.

What is claimed is:

1. A method for noise reduction in electric transformers housed in tanks subject to movements prior to installation and operation, comprising:

during transportation:

installing removable outer connectors for fastening a live part of the electric transformer to the tank, wherein the live part of the electric transformer comprises a core, a plurality of coils and fittings; and during transformer operation:

removing the removable outer connectors and replacing them by removable elements, attaching one of the removable elements to an outer connector;

uncoupling the live part; and fastening the inner connectors with damper elements for live part fastening, reducing vibration transmission.

2. The method for noise reduction according to claim 1, in which removing the removable outer connectors is performed by withdrawing screws coupling the removable connector with the outer connector.

3. The method for noise reduction according to claim 1, in which attaching one of the removable elements comprises creating a tight seal therebetween at each coupling point between fittings and the tank.

4. The method for noise reduction according to claim 1, in which the outer connector elements provide rigidity to the live part fastening member for withstanding generated forces by accelerations experienced during movement and transformer transportation.

5. The method for noise reduction according to claim 1, in which the damper elements limit vibration amplitude in the coupling between fittings and outer connectors.

* * * * *